US006530128B2

(12) United States Patent
Bunjes et al.

(10) Patent No.: US 6,530,128 B2
(45) Date of Patent: Mar. 11, 2003

(54) BELT BUCKLE

(76) Inventors: Hans Bunjes, Friedrichstrasse 59, D-26203 Wardenburg (DE); Curt Merker, Brodersenstrasse 110, D-81929 Muenchen (DE); Hjalmar Konzet, Obereck 6, D-83334 Inzell (DE)

( * ) Notice: Subject to any disclaimer, the term of this patent is extended or adjusted under 35 U.S.C. 154(b) by 0 days.

(21) Appl. No.: 09/826,071

(22) Filed: Apr. 4, 2001

(65) Prior Publication Data

US 2001/0029647 A1 Oct. 18, 2001

(30) Foreign Application Priority Data

Apr. 6, 2000 (DE) ..... 200 06 308 U

(51) Int. Cl.[7] ..... A44B 11/24
(52) U.S. Cl. ..... 24/178; 24/177; 24/307
(58) Field of Search ..... 24/178, 185, 191, 24/307, 163 R, 170, 265 WS, 265 BC, 188

(56) References Cited

U.S. PATENT DOCUMENTS

| | | | | | |
|---|---|---|---|---|---|
| 650,463 | A | * | 5/1900 | Horne | 24/163 R |
| 663,472 | A | * | 12/1900 | Scheuer | 24/178 |
| 663,473 | A | * | 12/1900 | Scheuer | 2/322 |
| 929,709 | A | * | 8/1909 | Rempel | 24/166 |
| 987,326 | A | * | 3/1911 | Savage | 24/164 |
| 1,894,654 | A | * | 1/1933 | Wirth | 24/163 R |
| 2,215,194 | A | * | 9/1940 | Ronci | 24/178 |
| 2,359,148 | A | * | 9/1944 | Partridge | 224/164 |
| 3,566,454 | A | * | 3/1971 | Schmidt | 24/165 |
| 4,470,174 | A | * | 9/1984 | Rhea | 24/16 PB |
| 5,765,265 | A | * | 6/1998 | Kang | 24/177 |

FOREIGN PATENT DOCUMENTS

| | | | | |
|---|---|---|---|---|
| DE | 55105 | | 5/1890 | |
| DE | 3308456 | A1 * | 9/1984 | |
| FR | 488198 | | 9/1918 | |
| GB | 223761 | | 10/1924 | |
| GB | 2109215 | A * | 6/1983 | |
| JP | 10-179214 | * | 7/1998 | 24/177 |

* cited by examiner

*Primary Examiner*—J. J. Swann
*Assistant Examiner*—André L. Jackson
(74) *Attorney, Agent, or Firm*—Milde & Hoffberg, LLP

(57) ABSTRACT

A belt buckle (2) has a frame-shaped buckle body (4) and a swiveling pin (24) that can be pushed through one of usually several longitudinally centered holes in the belt and locked, with the pin compressed by spring loading against a first transverse spar (10) of buckle body (4). The belt buckle is characterized in that the spring loading derives from a continuous elastomer band (28), which extends from a second transverse spar (12) of buckle body (4) at a small distance from the point of attachment of pin (24) around the pin. Such a buckle can be manufactured more easily, and thus profitably. It is functionally safer, and additionally has less danger of causing injury than a buckle equipped with a wire spring.

8 Claims, 1 Drawing Sheet

BELT BUCKLE

BACKGROUND OF THE INVENTION

The invention has to do with a belt buckle having a frame-shaped buckle body and a swiveling pin that can be pushed through one of usually several longitudinally centered holes in a belt and locked, with the pin biased by a spring against a first transverse spar of the buckle body.

Such belt buckles are known, and are customary, for example, in horseback riding, to attach the girth to the saddle straps of a saddle. Spring biasing of the pin makes it easy to "re-belt," i.e. re-tension the girth to the saddle straps from the saddle, which is desirable usually after a brief warmed-up period. Spring loading of the pin means that, using only one hand, the pin can be put into one of the holes of the particular saddle strap. Usually the pin consists of a torsion spiral spring that surrounds the bearing axis of the pin, the angled ends of which spring adjoin one of the buckle's two longitudinal spars on one side, and on the other side abut against the pin. This requires that the bearing axis be manufactured separately from the remaining buckle body and be inserted into it. In addition, there is a danger that the ends of the spring will slide off the longitudinal spar or the pin, and thus that the spring will lose its tension, becoming ineffective. Also, the ends of the spring, which project freely out into space, can cause injuries.

SUMMARY OF THE INVENTION

The principal objective of the present invention, therefore is to configure a belt buckle of the type described above so that it is easier to manufacture, more reliable, capable of functioning, and in addition safer with regard to avoiding injuries.

This objective, as well as other objectives which will become apparent from the discussion that follows, is achieved, in accordance with the present invention, by biasing the pin by means of a continuous elastomer band which extends around the pin from a second transverse spar of the buckle body at a small distance from the mounting point of the pin.

The elastomer band can easily be inserted into a buckle that in other respects is already complete, thus requiring no separately manufactured bearing axis for the pin. It cannot pop off accidentally. In the event that tension slackens due to aging or tearing, it can be replaced, even by an amateur. Lastly, it presents no threat of injury whatsoever.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
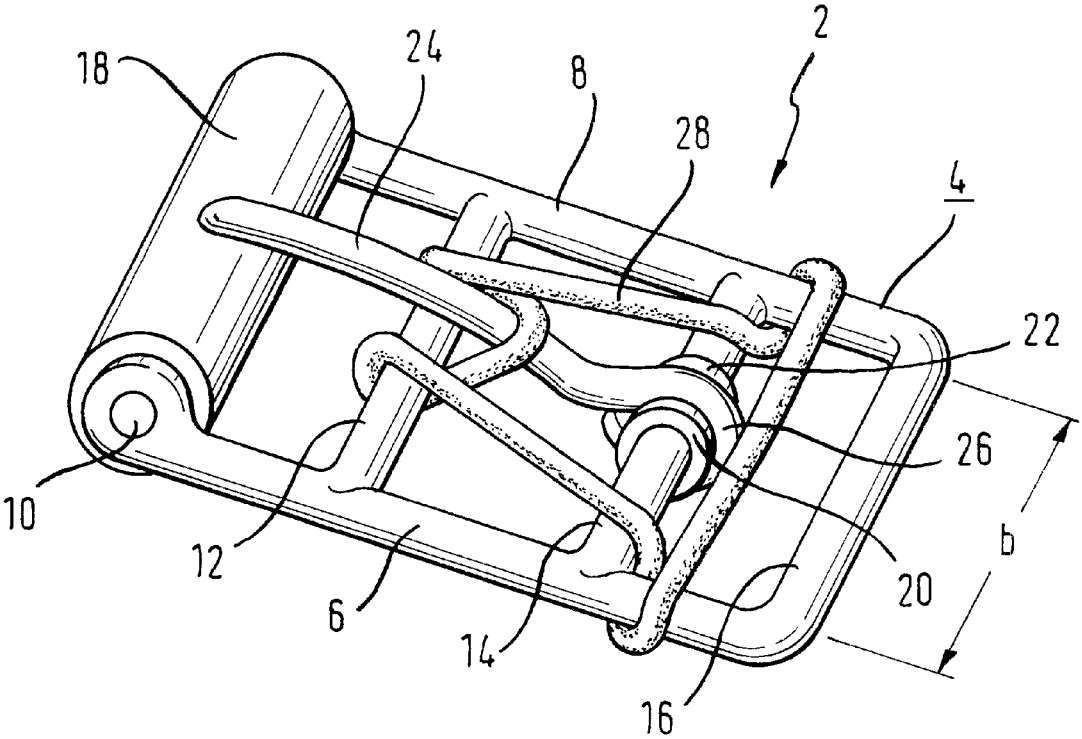
FIG. 1 shows the preferred embodiment of the belt buckle according to the present invention.

The preferred embodiments of the present invention will now be described with reference to single figure of the drawing.

The belt buckle 2 shown in FIG. 1 has an essentially rectangular buckle body 4, made out of brass, for example. It has two longitudinal spars 6 and 8, as well as a so-called first transverse spar 10, a second transverse spar 12, a third transverse spar 14 and a fourth transverse spar 16. While spars 12, 14 and 16 form a fixed component part with longitudinal spars 6 and 8, spar 10 is inserted into the ends referred to as longitudinal spars 6 and 8, and is surrounded by a solid roller 18 made of wear-resistant plastic such as nylon. Spar 14 has two cast-on flanges 20 and 22, and between them, pin 24 is attached in the middle so as to swivel, by having its attached end 26 bent around spar 14. Alternatively, the spar 14 could also be run through a borehole of an appropriately reinforced attached end of pin 24, or be manufactured as a single piece with it, for which it would then have to be inserted like spar 10 between spar 6 and 8.

Either way, pin 24 is subjected by an elastomer band 28 to a spring force directed onto spar 10 with roller 18. As can be seen, elastomer band 28 is run between spars 12 and 14 from below, around pin 24, then on both sides of pin 24 from below around spar 12, and over spar 14, whereupon it runs from beneath outwards around the two longitudinal spars 6 and 8.

Under certain circumstances, transverse spar 16, along with the ends of longitudinal spars 6 and 8 that project past transverse spar 14, is superfluous, and can be omitted. In this case, the elastomer band 28 must be run around spar 14 in some other manner. For example, elastomer band 28, after encircling spar 14, could be run a second time over pin 24.

It is appropriate for elastomer band 28 to have an essentially circular cross section. Such elastomer bands, perhaps for sealing purposes, can be obtained commercially as so-called O rings in all possible lengths and thicknesses.

It will be understood that the elastomer band 28 can be inserted into a belt buckle 2 which otherwise is fully assembled, and can likewise be replaced or exchanged with equal ease. It cannot cause any injuries, such as those which might arise from the sharpened ends of wire springs. Therefore, elastomer band 28 then exerts centered force on a relatively loosely anchored pin, such as pin 24 shown in the figure.

As can additionally be seen from the figure, roller 18 appropriately has a relatively large diameter, amounting preferably to a multiple of 0.4 to 0.6, and optimally 0.5 of the width of the buckle. Such a roller facilitates pulling the end of the belt through the buckle, and also makes it considerably easier for the pin to lock on its own into one of the belt holes.

There has thus been shown and described a novel belt buckle which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A belt buckle with a frame-shaped buckle body and a pin that swivels about a bearing axis and can be pushed through one of several longitudinally centered holes in a belt and locked, which pin is pressed by spring bias against a first transverse spar of the buckle body, the improvement wherein the spring bias derives from a continuous elastomer band, which extends around the pin from a second transverse spar of the buckle body which is at a smaller distance from the bearing axis of the pin than the first transverse spar.

2. Belt buckle according to claim 1, wherein the elastomer band extends from the second transverse spar over a third transverse spar of the buckle body, which forms the bearing axis of the pin, and from there extends laterally around two longitudinal spars of the buckle body.

3. Belt buckle according to claim 1, wherein the elastomer band extends from the second transverse spar, over a third transverse spar of the buckle body that forms the bearing axis of the pin, and from there extends a second time around the pin.

4. Belt buckle according to claim 1, wherein the first transverse spar includes a roller.

5. Belt buckle according to claim 4, wherein the exterior diameter of the roller is in the range of 0.4 to 0.6 times the buckle width.

6. Belt buckle according to claim 5, wherein the exterior diameter of the roller is substantially 0.5 times the buckle width.

7. Belt buckle according to claim 5, wherein said roller is a bar of solid material.

8. Belt buckle according to claim 7, wherein said material is Nylon.

* * * * *